United States Patent [19]

Date et al.

[11] Patent Number: 5,014,435

[45] Date of Patent: May 14, 1991

[54] CHAIN SAW GUIDE BAR

[75] Inventors: Yozo Date; Toshihiro Tsumura, both of Miki, Japan

[73] Assignee: Suehiro Seiko Kabushiki Kaisha, Miki, Japan

[21] Appl. No.: 556,612

[22] Filed: Jul. 23, 1990

[51] Int. Cl.[5] ..... B27B 17/02

[52] U.S. Cl. ..... 30/387; 30/383

[58] Field of Search ..... 30/381, 382, 383-387

[56] References Cited

U.S. PATENT DOCUMENTS

| | | | |
|---|---|---|---|
| 3,416,578 | 12/1968 | Irgens | 30/387 |
| 4,334,358 | 6/1982 | Reynolds | 30/387 |
| 4,381,606 | 5/1983 | Ekrud et al. | 30/387 |
| 4,837,934 | 6/1989 | Krohn | 30/383 X |

FOREIGN PATENT DOCUMENTS

| | | | |
|---|---|---|---|
| 333354 | 9/1989 | European Pat. Off. | 30/383 |

*Primary Examiner*—Douglas D. Watts

*Attorney, Agent, or Firm*—Marshall, O'Toole, Gerstein, Murray & Bicknell

[57] ABSTRACT

A chain saw guide bar including an inner plate and a pair of outer plates fixed to both flat sides of the inner plate. The inner plate has holes formed therethrough. The outer plates also have holes formed therethrough, but they are smaller than the holes of the inner plate. The outer holes are each aligned with one of the inner holes, and the holes are filled with a lightweight material.

6 Claims, 1 Drawing Sheet

CHAIN SAW GUIDE BAR

FIELD AND BACKGROUND OF THE INVENTION

The present invention relates to an improved chain saw guide bar.

The bar of a conventional chain saw has a weight which is a fairly large proportion of the total weight of the chain saw, and it is cantilevered from the engine housing. Japanese Utility Model Publication S. 52-21993 published on May 20, 1977 shows a chain saw guide bar including an inner plate and two outer plates adhered to its both sides. The inner plate has a number of holes formed therethrough and filled with an adhesive. Thus, the weight of the inner plate only is reduced, so that the reduction in weight of the whole bar is limited.

SUMMARY OF THE INVENTION

It is a general object of this invention to provide a chain saw guide bar which has its weight reduced by removing a relatively large portion thereof, with relatively little loss in rigidity and life of the bar.

A chain saw guide bar according to the invention includes an inner plate and a pair of outer plates fixed to both flat sides of the inner plate. The inner plate has holes formed therethrough. The outer plates also have holes formed therethrough, but they are smaller than the holes of the inner plate. The outer holes are each aligned with one of the inner holes, and the holes are filled with a lightweight material.

BRIEF DESCRIPTION OF THE DRAWINGS

Preferred embodiments of the invention are shown in the accompanying drawings, wherein.

DETAILED DESCRIPTION OF THE DRAWINGS

Figures 1, 2, 3, 4:
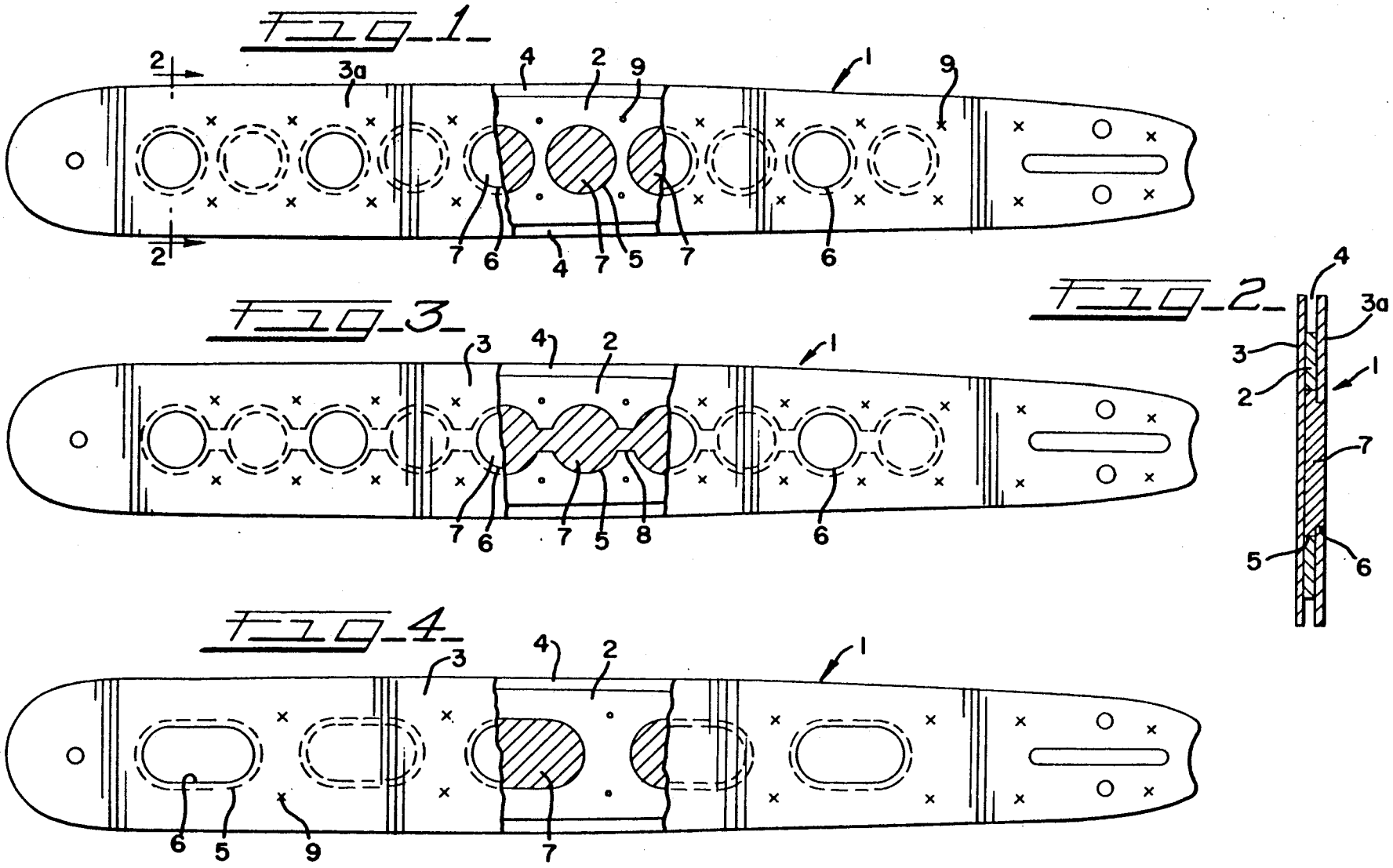
FIG. 1 is a side view partially cut away of a chain saw guide bar according to the invention.
FIG. 2 is an enlarged cross-sectional view taken along the line II—II of FIG. 1.
FIGS. 3 and 4 are views similar to FIG. 1, but showing alternative embodiments.

In FIGS. 1 and 2, a chain saw guide bar 1 includes an inner flat steel plate 2 and a pair of outer flat steel plates 3 and 3*a* which are secured to the opposite flat sides of the plate 2 by spot welding at the points 9. The upper and lower edges of the outer plates 3 and 3*a* extend beyond the inner plate 2 to thereby form peripheral guide grooves 4 for a chain (not shown) between the outer plates.

The inner plate 2 has a number of circular inner holes 5 formed therethrough in a row along substantially the longitudinal center line of the bar, and they are spaced longitudinally from each other. Each outer plate 3 and 3*a* has circular outer holes 6 formed therethrough and having a diameter somewhat smaller than that of the inner holes 5. The outer holes 6 of each outer plate 3 and 3*a* are each aligned with every other inner hole 5, and are offset from the holes 6 of the other outer plate.

Thus, the outer holes 6 in each of the plates 3 and 3*a* overlie alternate inner holes 5.

The holes 5 and 6 are filled with a synthetic resin 7 such as epoxy resin, which is light weight compared with the steel and is flush with the flat sides of outer plates 3 and 3*a*. As is best shown in FIG. 2, one of the two outer plates covers each hole 5 and the resin 7 on one side, and on the opposite side the smaller diameter of the outer hole 6 keeps the resin 7 from being taken out. Thus the resin 7 is securely anchored in the holes.

Part of resin 7 permeates and forms a thin film between the sides of the inner plate 2 and each outer plate 3 and 3*a* when filling the holes 5 and 6, and the resin then solidifies. The resin 7 also functions as an adhesive to increase the joining strength between the three plates 2, 3 and 3*a*.

In the embodiment of FIG. 3, the inner and outer plates 2, 3 and 3*a* have holes 5 and 6 which are substantially the same as shown in FIGS. 1 and 2. Adjacent inner holes 5 are interconnected by narrow removed portions or bridges 8 to further reduce the bar weight. The holes 5 and 6 and the portions 8 are filled with the synthetic resin 7 as previously described.

In the embodiment of FIG. 4, the inner and outer plates 2, 3, and 3*a* have oval holes 5 and 6 which are elongated longitudinally of the bar. Again, the inner holes 5 are larger than the outer holes 6 and the outer holes in each outer plate are offset from the holes of the other outer plate. The holes 5 and 6 are filled with the synthetic resin 7.

The elongated holes 5 and 6 increase both the hole area and the area of fixation between the plates 2 and 3 between the guide grooves 4 and the holes. The fixing strength by the resin 7 permeating and solidifying is thus increased to reduce the number of the spot welding points 9 needed, which produce thermal strain (stress).

The appearance and performance of a bar according to this invention does not materially differ from those of a conventional bar made of a single steel plate.

What is claimed is:

1. A chain saw guide bar comprising an inner plate having inner holes formed therethrough, outer plates sandwiching said inner plate and having outer holes formed therethrough, said outer holes being smaller than said inner holes in the inner plate, each of said outer holes being aligned with one of said inner holes, and a lightweight material filling said holes.

2. A chain saw guide bar according to claim 1, wherein said holes are arranged in a row longitudinal of said bar, said outer holes of each outer plate being offset from the outer holes of the other outer plate.

3. A chain saw guide bar according to claim 1, wherein adjacent ones of said larger holes are interconnected by a narrow removed portion.

4. A chain saw guide bar according to claim 2, wherein adjacent ones of said larger holes are interconnected by a narrow removed portion.

5. A chain saw guide bar according to claim 1 wherein said holes are elongated longitudinally of said bar.

6. A chain saw guide bar according to claim 2 wherein said holes are elongated longitudinally of said bar.

* * * * *